US005448862A

United States Patent [19]

Candiracci

[11] Patent Number: 5,448,862

[45] Date of Patent: Sep. 12, 1995

[54] PREFABRICATED COMPONENT FOR BUILDING STAIRCASES

[76] Inventor: Angelo Candiracci, Via Rosciano 16, 61032 Fano (Prov. of Pesaro), Italy

[21] Appl. No.: 35,767

[22] Filed: Mar. 23, 1993

[51] Int. Cl.[6] ..... E04F 11/02

[52] U.S. Cl. ..... 52/182; 52/192; 52/309.4; 52/309.7

[58] Field of Search ..... 52/182–191, 52/309.4, 309.7, 309.8, 309.9, 309.12, 309.14, 309.16, 309.11

[56] References Cited

U.S. PATENT DOCUMENTS

| | | | |
|---|---|---|---|
| 2,221,358 | 11/1940 | Neal | 52/190 |
| 2,615,325 | 10/1952 | Seeber | 52/190 |
| 3,405,486 | 10/1968 | Fagenstrom | 52/190 |
| 4,157,640 | 6/1979 | Joannes | 52/309.12 |

FOREIGN PATENT DOCUMENTS

| | | |
|---|---|---|
| 0520925 | 7/1953 | Belgium . |
| 1563687 | 4/1969 | France . |
| 2361512 | 3/1978 | France . |
| 2399514 | 3/1979 | France . |
| 1039212 | 9/1958 | Germany . |
| 1928399 | 12/1970 | Germany . |
| 2606865 | 8/1977 | Germany . |
| 2705231 | 8/1978 | Germany . |
| 3332695 | 4/1985 | Germany . |
| 4238950 | 8/1992 | Japan . |
| 630329 | 1/1947 | United Kingdom . |

*Primary Examiner*—Carl D. Friedman
*Assistant Examiner*—Winnie Yip
*Attorney, Agent, or Firm*—Guido Modiano; Albert Josif; Daniel O'Byrne

[57] ABSTRACT

The prefabricated component for building staircases comprises a supporting element made of foamed plastic material which extends longitudinally and is cut in the shape of steps along one of its upper surfaces. The supporting element is provided with a plurality of longitudinal holes which are meant for the insertion of respective metallic reinforcement frames and are suitable to be filled with a concrete casting when installed, to provide respective beams for stiffening the supporting element.

20 Claims, 2 Drawing Sheets

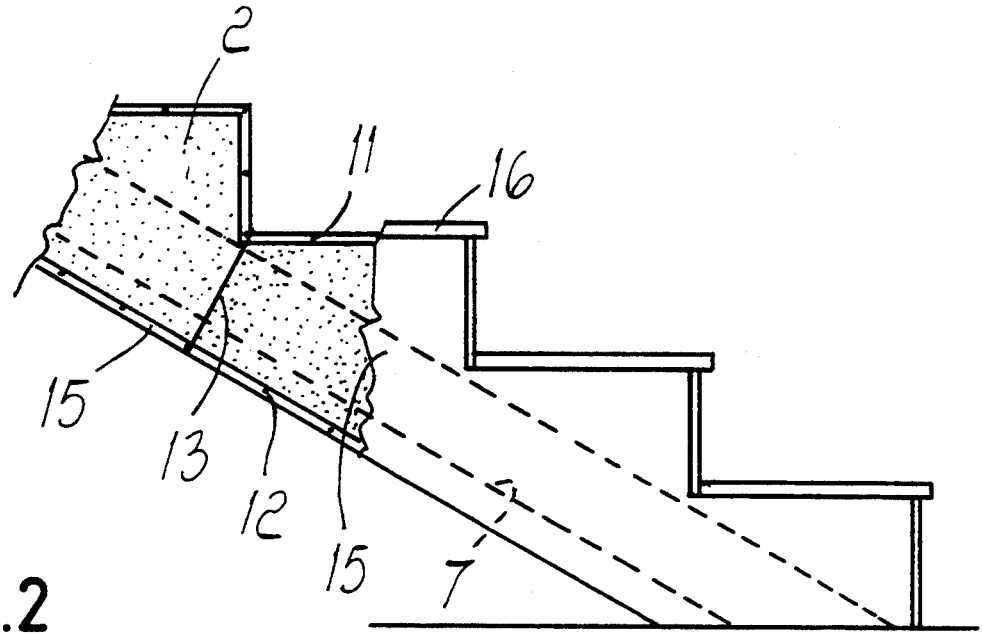
FIG.2
FIG.3
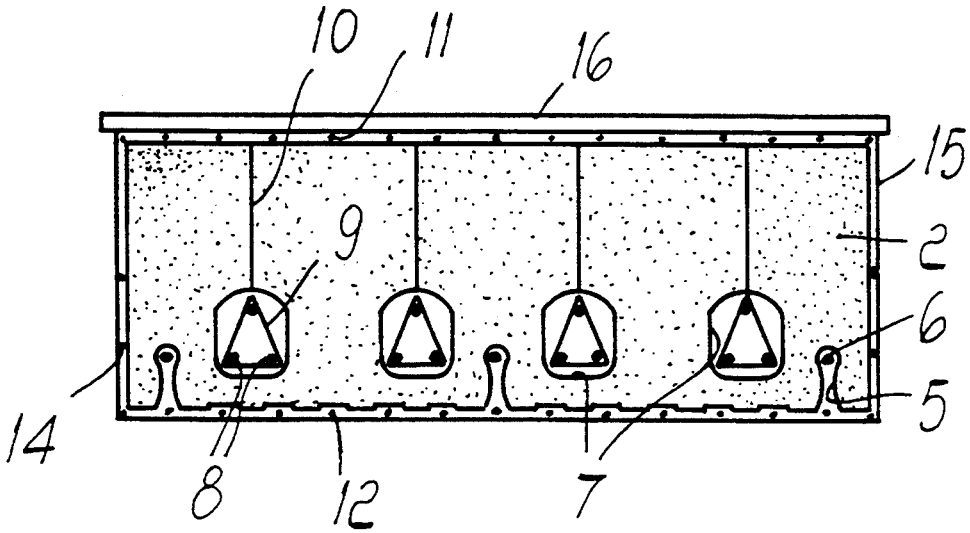

PREFABRICATED COMPONENT FOR BUILDING STAIRCASES

BACKGROUND OF THE INVENTION

The present invention relates to a prefabricated component for building staircases.

In the field of building, the need to build flights of stairs which generally have different dimensions, in terms both of extension and step shape, according to specific design choices, is known. For this purpose, conventional construction systems provide for the on-site execution of staircases in the required dimensions. However, this entails the use of considerable labor and requires relatively long work times.

On the other hand, the use of prefabricated components for building staircases has considerable limitations. Prefabricated components currently in use are in fact very heavy and are therefore difficult to transport and complicated to install. Said prefabricated components are furthermore unsuited for easy industrial production, since they must have different dimensions according to the construction requirements.

SUMMARY OF THE INVENTION

The aim of the present invention is to obviate these problems by providing a prefabricated component which allows to optimally build staircases, particularly facilitating the operations for transport and installation.

Within the scope of this aim, a further object of the present invention is to provide a component of the above described type which is simple in concept, has a low weight and great strength, and is versatile in use and relatively inexpensive.

This aim and this object are achieved, according to the invention, by the present prefabricated component for building staircases, which is characterized in that it comprises a supporting element made of foamed plastic material which extends longitudinally and is cut in the shape of steps along one of its upper surfaces, said element being provided with a plurality of longitudinal holes intended for the insertion of respective metallic reinforcement frames and suitable to be filled, when installed, with a concrete casting, to produce respective beams for stiffening said supporting element.

BRIEF DESCRIPTION OF THE DRAWINGS

The details of the invention will become apparent from the detailed description of a preferred embodiment of the prefabricated component for building staircases, illustrated only by way of non-limitative example in the accompanying drawings, wherein:

FIG. 2 is a side view of a flight of stairs built by means of said component;

FIG. 3 is a transverse sectional view of said stairs.

DESCRIPTION OF THE PREFERRED EMBODIMENTS

Figure 1:
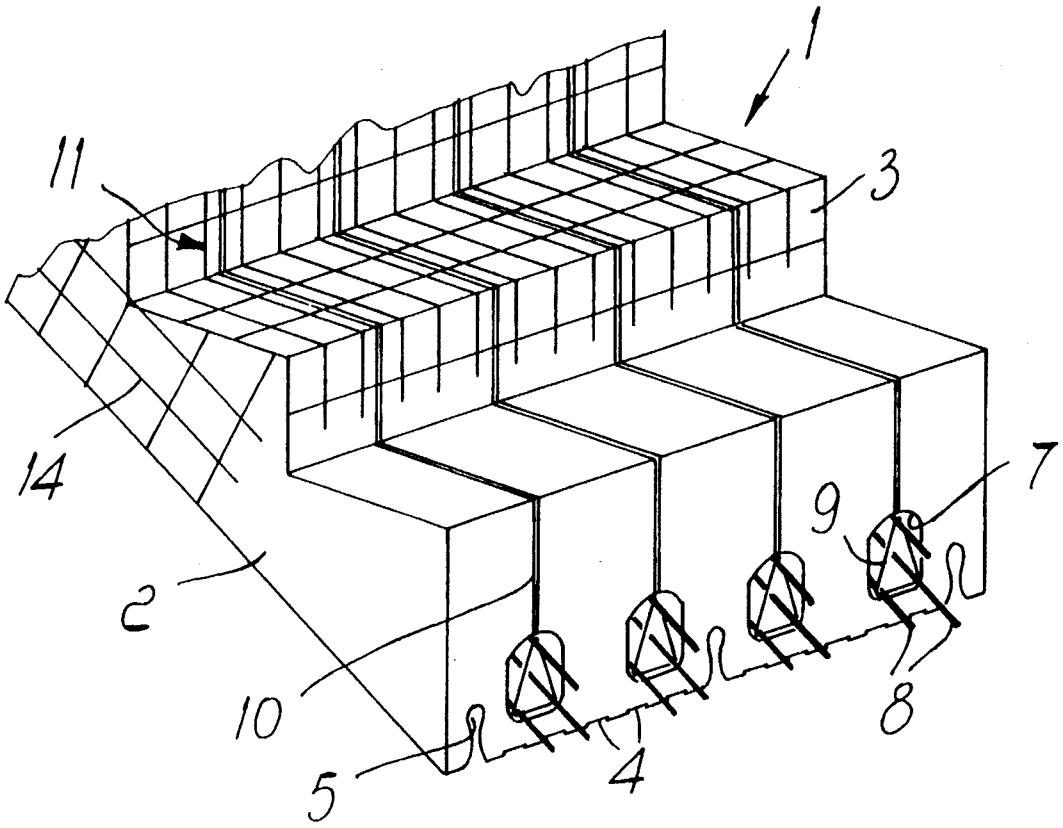
FIG. 1 is a perspective view of a portion of the prefabricated component according to the invention.

With particular reference to the above figures, a prefabricated component for building staircases is generally designated by the reference numeral 1.

The prefabricated component 1 is constituted by a supporting element 2 made of foamed material, such as polystyrene, which extends longitudinally and is cut in the shape of steps 3 along one of its upper surfaces. More particularly, the supporting element 2 is obtained from a piece of foamed material which is shaped like a parallelepiped and is cut in steps at the median plane by means of appropriate electronically-controlled devices suitable to vary as required the rise and tread dimensions of the steps 3. In practice, therefore, two mutually symmetrical supports of the above type are obtained simultaneously from a single piece of foamed material. This allows to maximally limit manufacturing waste, with optimum use of the material.

The lower surface of the support 2, which is meant to be inclined when installed, has a series of longitudinal grooves 4 which are arranged side by side so as to give a sort of undulated appearance to said surface. The grooves 4 extend over the entire length of the component.

A plurality of openings 5 which extend longitudinally over the entire length of the component is furthermore defined at the lower surface of the support 2. In the illustrated case, for example, said openings 5 are defined at the median section and proximate to the sides of the supporting element 2.

The openings 5 extend along longitudinally vertical planes, and their cross-section has a central narrowing, so as to define insertion seats for respective reinforcement rods 6. The openings 5 are in fact conveniently suitable to be filled, during the preparation of the prefabricated components, with a concrete casting so as to define beams for the reinforcement of the supporting element 2.

Said supporting element 2 is provided with a plurality of longitudinal holes 7 which are uniformly distributed along its transverse cross-section and extend parallel to the lower surface of said element.

Respective reinforcement beams are inserted in the holes 7 and are constituted by longitudinal rods 8 which are connected by brackets 9 on transverse planes; for example, the brackets 9 are folded in the shape of a triangle, and the rods 8 are arranged at the corners of said triangle. The holes 7 are meant to be filled with a concrete casting when installed, as specified hereinafter.

Conveniently, the holes 7 are defined with a single cutting operation by means of said electronically-controlled devices. This operation therefore cuts respective linear slots 10 which are connected, on longitudinally vertical planes, to the upper surface of the support 2. A pair of electrowelded metallic nets 11 and 12 with rectangular mesh is associated with the supporting element 2; said nets extend respectively at the upper step-like surface 3 and at the lower grooved surface. In particular, the upper metallic net 11 is folded so as to follow the profile of the steps 3, whereas the lower metallic net 12 conveniently has its longitudinal rods arranged respectively at the grooves 4 of the support 2 (see FIG. 3).

The metallic nets 11 and 12 are mutually connected by means of iron elements 13 which are driven transversely through the narrow portions of the support 2 (see FIG. 2). Essentially, the metallic nets 11 and 12 form a sort of lattice in which the support 2 is interposed.

Further lateral metallic nets 14 of the above type are furthermore associated with the sides of the support 2, at least on the sides of the staircase which are to possibly remain in view after installation. The described component has a very low weight and can therefore be transported and installed very easily, without resorting to special equipment. In particular, the component which defines a staircase of normal size can be easily carried manually and installed by two workers.

During installation, concrete is cast into the holes 7, which have been provided beforehand with the related metallic reinforcement frames. Respective beams for stiffening the component are thus defined and give adequate strength to the flight of stairs.

The surfaces of the component which are in view, particularly the lower and lateral surfaces, are then covered with an appropriate layer of plaster 15. The metallic nets are embedded in said layer of plaster 15. The upper step-like surface of the staircase is instead covered with an appropriate covering material 16.

The metallic nets associated with the supporting element 2 are furthermore suitable to spread the loads which act on the staircase. For this purpose, said metallic nets are appropriately embedded in a layer of cement.

The described prefabricated component ultimately allows to optimally solve the problems linked with the building of staircases and the like, by virtue of the lightness and strength characteristics which facilitate its installation.

The prefabricated component furthermore lends itself to industrial production, since it can be manufactured so as to comply with the different constructive requirements.

The supporting element made of foamed material is in fact obviously cut to the required dimensions by means of appropriate instructions given to the automatic cutting devices, varying its extension and proportions. For example, it is possible to envisage the construction of wider staircases by arranging two or more prefabricated components of the above described type side by side in a modular manner.

In the practical execution of the invention, the materials employed, as well as the shapes and dimensions, may be any according to the requirements.

I claim:

1. Prefabricated component for building staircases comprising;

a supporting element made of foamed plastic material and having a longitudinal extension, said supporting element having an upper surface and a lower surface;

a plurality of longitudinal openings formed in said lower surface of said supporting element and extending parallel to said longitudinal extension of said supporting element;

a plurality of steps defined by said supporting element at said upper surface thereof and each extending transversely with respect to said longitudinal openings;

a plurality of mutually parallel longitudinal holes extending through said supporting element parallel to said longitudinal openings, and;

a plurality of linear slots formed longitudinally in said upper surface and extending parallel to said longitudinal holes and parallel to said longitudinal openings, each one of said slots communicating with at least one of said plurality of mutually parallel longitudinal holes.

2. Prefabricated component according to claim 1, wherein said supporting element has formed therein a plurality of longitudinal grooves, said longitudinal grooves extending parallel to said longitudinal openings, said longitudinal holes, and said linear grooves.

3. Prefabricated component according to claim 1, wherein said supporting element defines a transverse cross-section, and wherein said plurality of mutually parallel longitudinal holes are uniformly distributed along said transverse cross-section.

4. Prefabricated component according to claim 1, wherein said plurality of mutually parallel longitudinal holes comprises at least four longitudinal holes.

5. Prefabricated component according to claim 1, wherein said plurality of linear slots comprises at least four linear slots.

6. Prefabricated component according to claim 1, wherein said supporting element has a median section and sides, and wherein said plurality of longitudinal openings comprise at least three longitudinal openings, at least one of said openings being located on said lower surface at said median section of said supporting element, at least two of said openings being located on said lower surface proximate to said sides of said supporting element.

7. Prefabricated component according to claim 1, wherein said plurality of longitudinal openings each have an opening cross-section, said opening cross-section defining central narrowing, said central narrowing defining a reinforcement rod insertion seat.

8. Prefabricated component according to claim 1, further comprising a plurality of reinforcement beams, each of said reinforcement beams comprising longitudinal rods and brackets, said brackets transversely interconnecting said longitudinal rods, at least one of said reinforcement beams being inserted into each of said plurality of mutually parallel longitudinal holes.

9. Prefabricated component according to claim 8, wherein said brackets comprise triangular brackets defining corners, and wherein each of said reinforcement beams comprise at least three of said rods, one of said at least three rods being connected to each of said corners of said triangular brackets.

10. Prefabricated component according to claim 2, further comprising at least two electrowelded metallic nets, at least one of said electrowelded metallic nets extending stepwise along said upper surface of said supporting element, another of said nets extending along said lower surface of said supporting element parallel to said plurality of longitudinal grooves.

11. Prefabricated component according to claim 10, further comprising sides defined by said supporting element, and lateral metallic nets, said lateral metallic nets extending over said sides of said supporting element between said one of said electrowelded metallic nets extending stepwise along said upper surface of said supporting element and said other of said nets extending along said lower surface of said supporting element.

12. Prefabricated component for building staircases comprising;

a supporting element made of foamed plastic material and having a longitudinal extension, said supporting element having an upper surface and a lower surface;

a plurality of longitudinal openings formed in said lower surface of said supporting element and extending parallel to said longitudinal extension of said supporting element;

a plurality of steps defined by said supporting element at said upper surface thereof and each extending transversely with respect to said longitudinal openings;

a plurality of mutually parallel longitudinal holes extending through said supporting element parallel to said longitudinal openings;

a plurality of linear slots formed longitudinally in said upper surface and extending parallel to said longitudinal holes and parallel to said longitudinal openings, each one of said slots communicating with at least one of said plurality of mutually parallel longitudinal holes a plurality of reinforcement beams, at least one of said reinforcement beams being inserted into each of said plurality of mutually parallel longitudinal holes, and;

at least two electrowelded metallic nets, at least one of said electrowelded metallic nets extending stepwise along said upper surface of said supporting element, another of said nets extending along said lower surface of said supporting element parallel to said plurality of longitudinal grooves.

13. Prefabricated component according to claim 12, wherein said supporting element has formed therein a plurality of longitudinal grooves, said longitudinal grooves extending parallel to said longitudinal openings, said longitudinal holes, and said linear grooves.

14. Prefabricated component according to claim 12, wherein said supporting element defines a transverse cross-section, and wherein said plurality of mutually parallel longitudinal holes are uniformly distributed along said transverse cross-section.

15. Prefabricated component according to claim 12, wherein said plurality of mutually parallel longitudinal holes comprises at least four longitudinal holes.

16. Prefabricated component according to claim 12, wherein said plurality of linear slots comprises at least four linear slots.

17. Prefabricated component according to claim 12, wherein said supporting element has a median section and sides, and wherein said plurality of longitudinal openings comprise at least three longitudinal openings, at least one of said openings being located on said lower surface at said median section of said supporting element, at least two of said openings being located on said lower surface proximate to said sides of said supporting element.

18. Prefabricated component according to claim 12, wherein said plurality of longitudinal openings each have an opening cross-section, said opening cross-section defining central narrowing, said central narrowing defining a reinforcement rod insertion seat.

19. Prefabricated component according to claim 12, wherein each of said reinforcement beams comprises longitudinal rods and brackets, said brackets transversely interconnecting said longitudinal rods, and wherein said brackets comprise triangular brackets defining corners, and wherein each of said reinforcement beams comprise at least three of said rods, one of said at least three rods being connected to each of said corners of said triangular brackets.

20. Prefabricated component according to claim 12, further comprising lateral metallic nets, and sides defined by said supporting element, said lateral metallic nets extending over said sides of said supporting element between said one of said electrowelded metallic nets extending stepwise along said upper surface of said supporting element and said other of said nets extending along said lower surface of said supporting element.

* * * * *